US007201021B2

(12) United States Patent
Hartgrove

(10) Patent No.: US 7,201,021 B2
(45) Date of Patent: Apr. 10, 2007

(54) JEWELRY ARTICLE HAVING MAGNETIC ELEMENTS AND INTERCHANGEABLE SETTINGS

(75) Inventor: Ronald W Hartgrove, Houston, TX (US)

(73) Assignee: Heart & Company, Houston, TX (US)

( * ) Notice: Subject to any disclaimer, the term of this patent is extended or adjusted under 35 U.S.C. 154(b) by 102 days.

(21) Appl. No.: 10/684,938

(22) Filed: Oct. 14, 2003

(65) Prior Publication Data

US 2004/0074259 A1 Apr. 22, 2004

Related U.S. Application Data

(62) Division of application No. 10/252,316, filed on Sep. 23, 2002, now Pat. No. 6,715,315.

(51) Int. Cl.
*A44C 17/02* (2006.01)

(52) U.S. Cl. ..... 63/29.2; 63/29.1; 63/40

(58) Field of Classification Search ..... 63/1.11, 63/3, 20, 1.16–1.18, 15–15.8, 26, 29.1, 29.2, 63/31, 33, 40; 24/303
See application file for complete search history.

(56) References Cited

U.S. PATENT DOCUMENTS

| | | | | |
|---|---|---|---|---|
| 899,296 | A * | 9/1908 | Elliot | 63/29.1 |
| 3,115,758 | A * | 12/1963 | Eberle et al. | 63/15 |
| 3,307,375 | A * | 3/1967 | Estrin et al. | 63/15 |
| 3,639,949 | A * | 2/1972 | Beck | 63/29.1 |
| 4,416,074 | A * | 11/1983 | Guerrero et al. | 63/23 |
| 4,783,974 | A * | 11/1988 | Hernandez | 63/1.16 |
| 5,228,317 | A * | 7/1993 | Hendricks | 63/15.7 |
| 5,722,260 | A * | 3/1998 | Mangano | 63/3.1 |
| 6,305,192 | B1 * | 10/2001 | Indiveri et al. | 63/12 |
| 6,470,708 | B1 * | 10/2002 | Green | 63/3.2 |
| 6,594,871 | B2 * | 7/2003 | Hoffman | 24/303 |
| 6,688,139 | B2 * | 2/2004 | Tschetter | 63/31 |
| 6,718,797 | B2 * | 4/2004 | Plumly | 63/18 |
| 2002/0083737 | A1 * | 7/2002 | Esposito, Jr. | |
| 2002/0139142 | A1 * | 10/2002 | Marandola, Jr. | |

FOREIGN PATENT DOCUMENTS

| | | | |
|---|---|---|---|
| EP | 1 285 858 | A2 * | 2/2003 |
| FR | 2 681 653 | A1 * | 3/1993 |

(Continued)

*Primary Examiner*—Robert J. Sandy
*Assistant Examiner*—Ruth C. Rodriguez
(74) *Attorney, Agent, or Firm*—Howrey LLP

(57) ABSTRACT

Jewelry articles having magnetic elements and interchangeable settings are disclosed. In one aspect, the jewelry articles include magnetically coupling body portions and interchangeable settings. The body portions magnetically couple together to hold the interchangeable settings. For example, the body portions can magnetically couple together using rare earth magnets to form a composite ring. Preferably, at least one of the body portions is rotatable to tangentially break the magnetic coupling between the body portions to interchange the setting. In another aspect of the present invention, magnetic elements are used to magnetically suspend a movable setting on a jewelry article. An longitudinal member has at least one end connected to the jewelry article. The setting is movably disposed on the longitudinal member. A first magnetic element adjacent an end of the longitudinal member magnetically repels a second magnetic element on the setting.

17 Claims, 9 Drawing Sheets

FOREIGN PATENT DOCUMENTS

| | | | | |
|---|---|---|---|---|
| FR | 2 777 364 | A1 | * | 10/1999 |
| GB | 20 42 869 | A | * | 10/1980 |
| GB | 2 315 982 | A | * | 2/1998 |
| JP | 08038224 | A | * | 2/1996 |
| WO | WO 03/045184 | A1 | * | 6/2003 |

* cited by examiner

JEWELRY ARTICLE HAVING MAGNETIC ELEMENTS AND INTERCHANGEABLE SETTINGS

CROSS-REFERENCE TO RELATED APPLICATIONS

This is a divisional of application Ser. No. 10/252,316, filed Sep. 23, 2002 now U.S. Pat. No. 6,715,315, to which priority is claimed and which is incorporated herein by reference in its entirety.

FIELD OF THE INVENTION

The present invention relates generally to jewelry articles, and more particularly to jewelry articles having magnetic elements and having interchangeable and/or movable settings.

BACKGROUND OF THE INVENTION

The desirability of having jewelry articles, such as rings, pendants, earrings, bracelets, or broaches, with interchangeable settings has long been evident in the art. Being interchangeable, the setting can be matched to other articles of jewelry, clothing, or accessories. In my co-pending U.S. patent application Ser. No. 09/982,662, entitled "Decorative Articles with Interchangeable Settings," I disclose interchangeable modules, which attach to decorative articles using mechanical structures. In the present application, however, jewelry articles having magnetic elements are disclosed. In one aspect of the present invention, the magnetic elements are used to magnetically couple portions of the jewelry article together to hold an interchangeable setting. In another aspect of the present invention, the magnetic elements are used to magnetically suspend a movable setting on a jewelry article.

Jewelry articles having magnets are disclosed in the art. For example, U.S. Pat. Nos. 4,059,971; 4,195,492; 4,424,689; 4,912,944; 4,982,581; 5,193,360; 5,283,966; 5,806,346; 6,101,843; and 6,305,192 and U.S. Patent Application Publications 2001/0052245 and 2002/0073732 disclose articles of jewelry having magnets.

In one example, U.S. Pat. No. 5,353,608 to Berkowitz discloses a jewelry device having a setting member and a pair of hoops. The setting member has first and second display objects in opposite facing directions. The pair of hoops is pivotably connected to the setting member. The hoops can be rotated in opposite directions above and below the setting member to either display the first or second objects. When lying adjacent one another, the hoops are held together by a magnets at the bottom of the hoops. The setting is permanently and pivotally connected to the hoops. The hinged connections between the hoops and the setting member are difficult to manufacture and difficult to disguise on the jewelry article, which decreases the aesthetic value. In addition, the setting member can hold only two display objects, which limits the use of the jewelry article with other decorative articles.

In another example, U.S. Pat. No. 4,052,864 to Hofsaess discloses a jewelry article having a perpendicular mounting stem. A pendulum member is rotatable on the stem and has at least one pair of oppositely disposed magnets radially mounted thereto. A platform having various decorative elements is disposed above the pendulum and is freely rotatable about the mounting stem. The platform also includes a pair of magnets, which are radially aligned with the magnets of the pendulum. The identical magnetic pole of each pair of magnets and is juxtaposed, one above the other, causing a repulsing rotational action therebetween. To achieve the rotation, the platform and pendulum require complex bearing structures on the mounting stem.

The present invention is directed to overcoming, or at least reducing the effects of, one or more of the problems set forth above.

SUMMARY OF THE INVENTION

Jewelry articles having magnetic elements and interchangeable settings are disclosed. In one aspect, the jewelry articles include magnetically coupling body portions and interchangeable settings. The body portions magnetically couple together to hold the interchangeable settings. For example, the body portions can magnetically couple together using rare earth magnets to form a composite ring. Preferably, at least one of the body portions is rotatable to tangentially break the magnetic coupling between the body portions to interchange the setting.

In another aspect of the present invention, magnetic elements are used to magnetically suspend a movable setting on a jewelry article. An longitudinal member has at least one end connected to the jewelry article. The setting is movably disposed on the longitudinal member. A first magnetic element adjacent an end of the longitudinal member magnetically repels a second magnetic element on the setting.

The foregoing summary is not intended to summarize each potential embodiment or every aspect of the invention disclosed herein.

BRIEF DESCRIPTION OF THE DRAWINGS

The foregoing summary, preferred embodiments, and other aspects of the present invention will be best understood with reference to a detailed description of specific embodiments of the invention, which follows, when read in conjunction with the accompanying drawings, in which.

Figure 1:
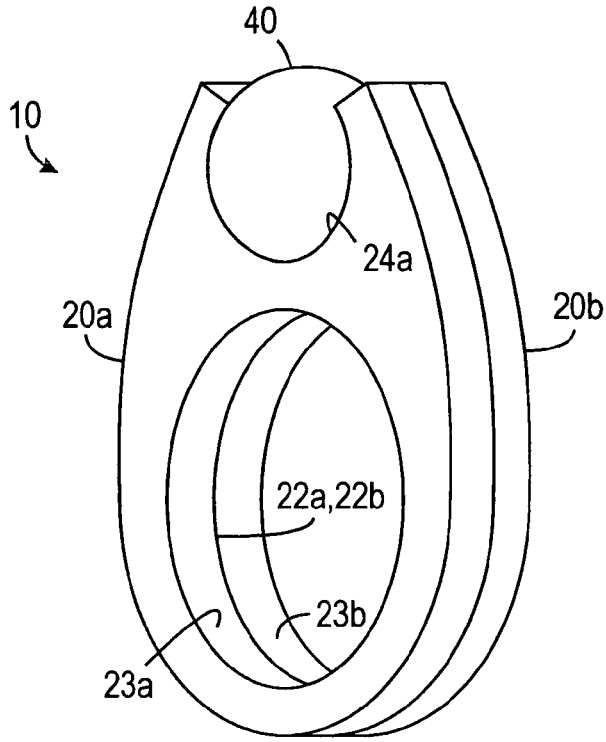
FIG. 1 illustrates a perspective view of a first embodiment of a jewelry article having magnetically coupling body portions and an interchangeable setting according to the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the scope of the invention as defined by the appended claims.

DETAILED DESCRIPTION OF THE INVENTION

Referring to FIGS. 1–3B, an embodiment of a jewelry article 10 in accordance with the present invention is illustrated. In FIG. 1, the jewelry article is illustrated in a perspective view having an interchangeable setting 40. The jewelry article 10 includes first and second body portions 20*a* and 20*b*. This and other embodiments of the jewelry articles illustrated herein, including embodiments of the body portions and interchangeable settings, are depicted in a basic form to show the gross anatomy of the present invention more clearly. It is understood that these basic forms can be aesthetically designed or altered by one of ordinary skill in the art without departing from the present invention.

The body portions 20*a* and 20*b* are substantially identical. As will become evident below, however, the body portions 20*a* and 20*b* need not be strictly identical. The body portions 20*a* and 20*b* can be composed of a suitable material, such as a precious metal, and can be formed by methods known in the art, such as machining, casting, soldering, or a combination thereof.

The first and second body portions 20*a* and 20*b* magnetically couple together to hold the interchangeable setting 40. In the present embodiment, the first and second body portions 20*a* and 20*b* magnetically couple together to form a composite ring 10. Thus, an opening 23*a* and 23*b* is defined in each of the body portions 20*a* and 20*b* to receive a finger of a person wearing the ring 10. However, one of ordinary skill in the art will appreciate that the body portions 20*a* and 20*b* according to the teachings of the present invention can be applied to other jewelry articles, such as earrings, bracelets, broaches, or pendants.

Each of the body portions 20*a* and 20*b* has a coupling side 22*a* and 22*b* and has a holding portion or mounting areas 24*a* and one not shown. In this and other embodiment, the holding portions 24*a* and one not shown define negative areas in the body portions, although this is not strictly necessary as will be evident herein. The coupling sides 22*a* and 22*b* are complimentary to one another and magnetically couple together, as will be discussed in more detail below. Preferably, the outside surfaces of the ring 10 adjacent the coupling sides 22*a* and 22*b* are machined and polished to substantially hide the mating, adjacent edges of the body portions 20*a* and 20*b*.

The interchangeable setting 40 is capable of being positioned in the mounting areas 24*a* and one not shown and held therein, as will be discussed in more detail below. In the present embodiment, the interchangeable setting 40 defines a sphere. As will become evident below, however, interchangeable settings according to the teachings of the present invention can have a number of shapes or forms, including interchangeable settings having other radial surfaces or having rectilinear surfaces.

Figure 2:
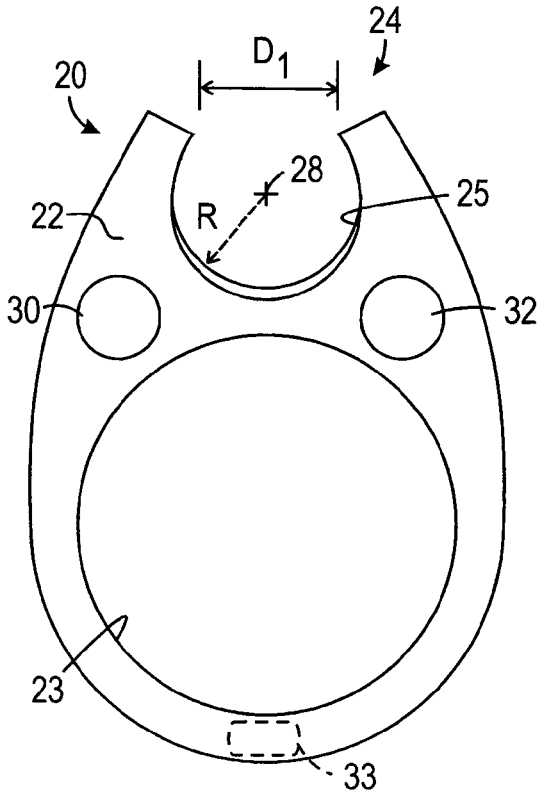
FIG. 2 illustrates a front view of a first body portion of the jewelry article of FIG. 2.

Referring now to FIG. 2, one of the body portions 20 of the ring 10 of FIG. 1 is shown in a front view to illustrate additional details. As discussed above, the body portion 20 has a coupling side 22 with a finger opening 21 defined therethough. The coupling side 22 is a substantially flat surface and includes at least one magnetic element 30. Preferably, the coupling side 22 includes two magnetic elements 30 and 32. The magnetic elements 30 and 32 can have a number of shapes other than the circular shapes shown here.

At least one of the magnetic elements, for example element 30, is a permanent magnet. The permanent magnet can be, but is not limited to, a ferrite magnet, an alnico magnet, a rare earth-neodymium magnet, a rare earth-samarium cobalt magnet, or a sintered neodymium-iron-boron compound. The required dimensions and magnetic force for the magnetic elements depends on a number of variables, including the dimensions and weights of the jewelry article and interchangeable setting and a predetermined force to uncouple the magnetic element, for example. Determining the required dimensions and magnetic force for the magnetic elements on such variables falls within the ability of one having ordinary skill in the art.

The other magnetic element, for example element 32, can be substantially similar to the first magnetic element 30 and can have the same polarity as the first magnetic element 30. Alternatively, it will be appreciated that the second magnetic element 32 can include a piece of ferromagnetic material intended to mate with a permanent magnet on the other body portion (not shown). The magnetic elements 30 and 32, including permanent magnets or ferromagnetic materials, can be affixed with epoxy into holes formed in the coupling side 22 of the body portion 20. It will be appreciated that the magnetic elements 30 and 32 need not be strictly located between the finger opening 23 and the mounting area 24 as shown, although this location is preferable as it provides suitable space for the placement of the elements 30 and 32 in the material of the body portion 20. Furthermore, an additional magnetic element 33 can be located adjacent the finger opening 23, as shown in FIG. 2.

For the composite ring 10 of the present embodiment, both magnetic elements 30 and 32 are preferably rare earth-neodymium magnets, which provide substantially powerful magnetic fields relative to their size. For illustrative purposes only, the gross dimensions of the composite ring 10 can be about 1¼-inch by ⅞-inch by ¼-inch, although it is understood that these dimensions can be varied and do not limit the present invention in any way. The magnets 30 and 32 are disc-shaped, having an approximate diameter of 4.8-mm and a thickness of about 1.6-mm. The magnetic elements 30 and 32 preferably have the same polarity adjacent the mounting side 22 and mate with the opposing polarity of rare earth-neodymium magnets on the other body portion.

The mounting area 24 receives a portion of the interchangeable setting (not shown in FIG. 2) from a direction of the first coupling side 22 (i.e., perpendicularly towards FIG. 2). The mounting area 24 is capable of positively engaging the portion of the setting except in the direction of the coupling side 22. As discussed above, the interchangeable setting 40 of FIGS. 1–3B is spherical. Consequently, the mounting area 24 in the present embodiment has a partially spherical surface 25 defined by a radius R from a center 28. To positively engage the portion of the setting except in the direction of the coupling side 22, a circumferential dimension defined by the spherical surface 25 is at least greater than half of a circle. In this way, an open, upper dimension $D_1$ of the mounting area 24 is less than the diameter (2R) of the surface 25. In addition, the partially spherical surface 25 defines a greater dimension adjacent the coupling side 22 than on the opposing side of the body portion 20. Thus, the setting can be received in the mounting area 24 from the coupling side 22 but cannot pass through the opposing side of mounting area 24.

Figure 3A:
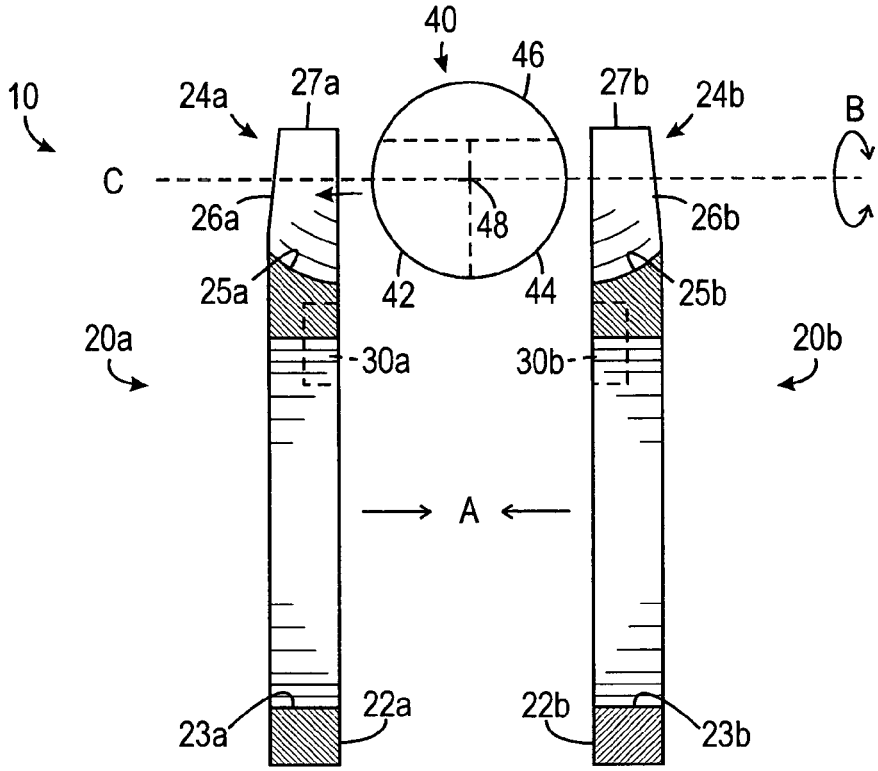
FIG. 3A illustrates a side view of a stage of coupling the body portions and interchangeable setting of the jewelry article of FIG. 2.

Referring to FIG. 3A, the body portions 20*a* and 20*b* and interchangeable setting 40 of the jewelry article 10 of FIGS. 1 and 2 are shown in a stage of coupling together. For illustrative purposes, the body portions 20*a* and 20*b* are shown in cross-section to reveal addition details. In general, the interchangeable setting 40 includes a first mounting portion 42, a second mounting portion 44, and a decorative portion 46. Being spherical in the present embodiment, the interchangeable setting 40 realistically has only one spherical surface embodying all of the portions 42, 44, and 46. Designating the distinct mounting portions 42 and 44 and decorative portion 46 is made for the benefit of other embodiments of interchangeable settings disclosed herein and is made to provide relative terminology for coupling the body portions 20*a* and 20*b* and the setting 40 together.

As best shown in FIG. 3A, the mounting areas 24*a* and 24*b* include the partially spherical surfaces 25*a* and 25*b* for engaging the mounting portions 42 and 44 of the setting 40. The mounting areas 24*a* and 24*b* define greater openings adjacent the coupling sides 22*a* and 22*b* of the body portions 20*a* and 20*b* than are defined at open sides 26*a* and 26*b* of the mounting areas 24*a* and 24*b*. The top sides 27*a* and 27*b* of the mounting areas 24*a* and 24*b* are open so that the decorative portion 46 of the setting 40 can be viewed.

To form the composite ring 10, the interchangeable setting 40 is first positioned in one of the mounting areas 24*a* from the direction of the coupling side 22*a*. The setting 40 is thereby held in the mounting area 24*a* in all directions except towards the coupling side 22*a*. The body portions 20*a* and 20*b* are then coupled in direction A. The magnetic elements 30*a*, 30*b* and others not shown on the respective coupling surfaces 22*a* and 22*b* are aligned and magnetically couple. The mounting areas 24*a* and 24*b* therefore positively hold the interchangeable setting 40 to the coupled body portions 20*a* and 20*b*.

The first magnetic element 30*a* has a first polarity. The opposing magnetic element 30*b*, if also a magnet, has a second polarity opposite the first polarity so that the elements 30*a* and 30*b* can magnetically couple when positioned adjacent one another. Alternatively, one of the magnetic elements, for example 30*a*, can be a magnet, while the other element 30*b* can simply be material of the body portion 20*b* if the body portion is of sufficient magnetic permeability. Alternatively, the other element 30*b* can be a magnetically permeable material embedded in the body portion 20*b*.

Figure 3B:
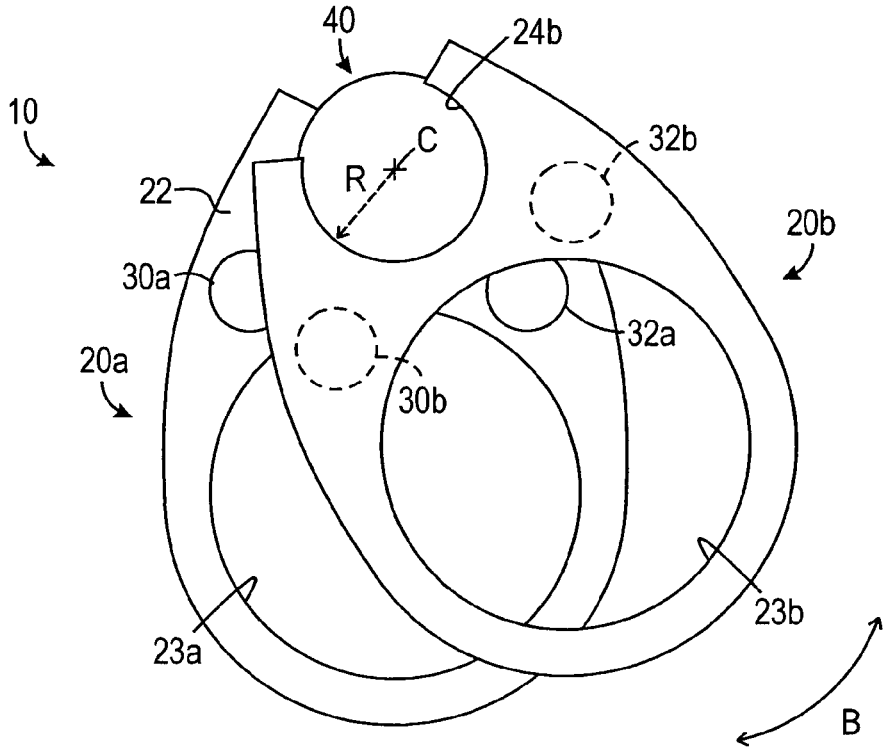
FIG. 3B illustrates a front view of a stage of uncoupling the body portions and interchangeable setting of the jewelry article of FIG. 2.

Referring to FIG. 3B, the jewelry article 10 is illustrated in a front view. The body portions 20*a* and 20*b* and interchangeable setting 40 are shown in a stage of uncoupling. Preferably, at least one of the body portions 20*a* or 20*b* is capable of rotating in direction B about the setting 40. In the present embodiment, either one or both of the body portions 20*a* and 20*b* are capable of rotating about the setting 40 in direction B to break the magnetic coupling of the elements 30*a*, 30*b* and 32*a*, 32*b*. Although preferred, having at least one rotating body portion is not strictly necessary, as will be evidenced herein.

Rotation of the second body portion 20*b* tangentially breaks the magnetic engagement between the magnetic elements 30*a*, 30*b* and 32*a*, 32*b*. With the magnetic engagement broken, the body portions 20*a* and 20*b* can be separated, freeing the setting 40 from the complimentary mounting areas 24*a* and 24*b*. Rotation of the second body portion 20*b* occurs about the setting 40 held in the mounting area 24*b*. The center 28 of the mounting area 24*b* defines an axis of rotation C that substantially aligns with a central axis or center of the interchangeable setting 40. Because the setting 40 is spherical in the present embodiment, the axis of rotation C passes through the center 48 of the spherical setting 40. Once uncoupled, another interchangeable setting (not shown) having a different composition or aesthetic appearance, for example, can be positioned in the mounting areas 24*a* and 24*b* and held by the magnetically coupled body portions 20*a* and 20*b*.

Figure 4A:
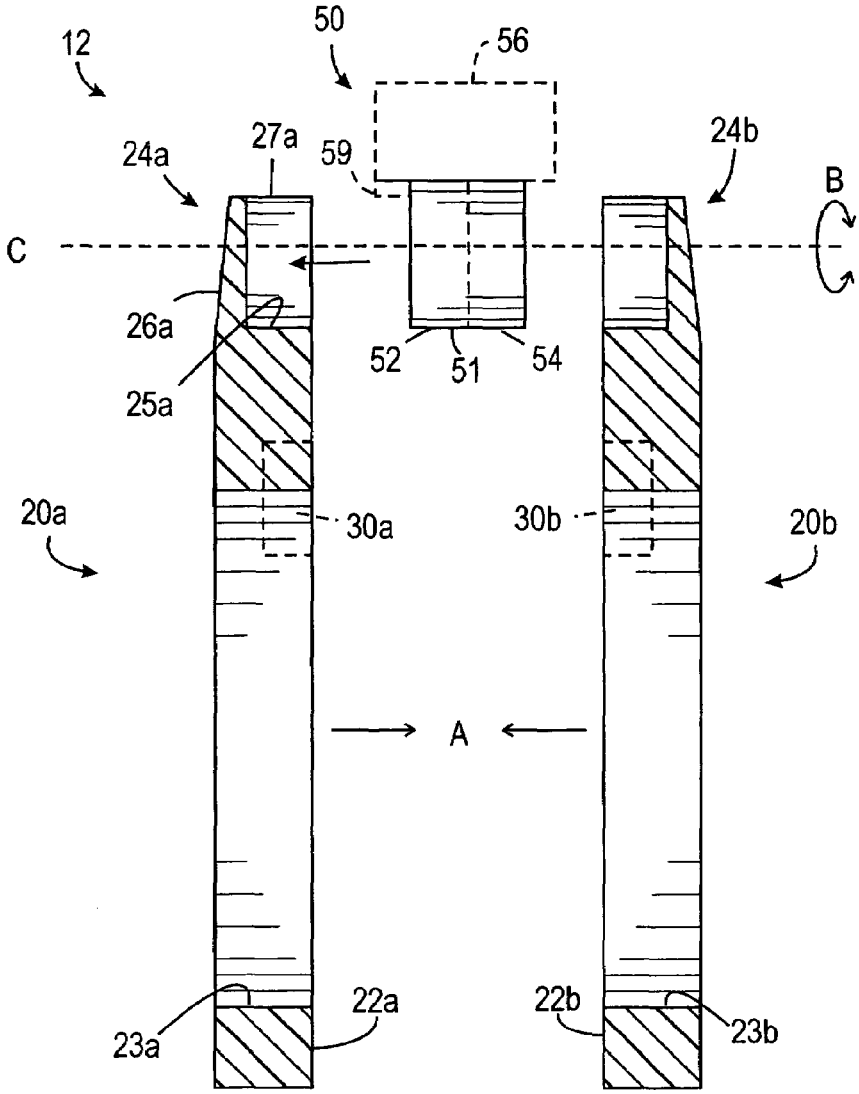
FIGS. 4A–B illustrate various views of a second embodiment of a jewelry article having magnetically coupling body portions and an interchangeable setting according to the present invention.
Figure 4B:
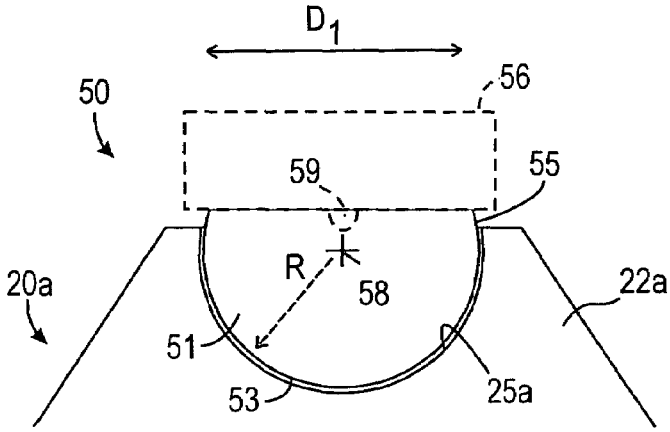

Referring to FIGS. 4A–B, another embodiment of a jewelry article 12 having magnetically coupling body portions 20*a* and 20*b* and an interchangeable setting 50 according to the present invention are illustrated. In FIG. 4A, first and second body portions 20*a* and 20*b* of the jewelry article 12 are shown in a stage of coupling to one another to hold the interchangeable setting 50. The first and second body portions 20*a* and 20*b* are illustrated in a side, cross-sectional view to show internal details. In a front view of FIG. 4B, the setting 50 is shown installed in a mounting area 24*a* of the first body portion 20*a*. The first and second body portions 20*a* and 20*b* are substantially similar to those discussed above with reference to FIGS. 1–3. For brevity, like reference numerals are used to indicate substantially similar elements between embodiments.

The interchangeable setting 50 includes a mounting portion 51 and a decorative portion 56. The mounting portion 51 is a partial disc having a first mounting side 52 and a second mounting side 54. As best shown in FIG. 4B, the partial disc 51 defines a cylindrical surface 53 defined by a radius R from a center 58. A circumferential dimension of the cylindrical surface 53 is at least greater than half of a circle so that an upper dimension $D_2$ of the disc 51 is less than the diameter (2R) of the cylindrical surface 53. The decorative portion 56 can have any particular shape.

As in the embodiment of FIGS. 1–3 above, the first and second body portions 20*a* and 20*b* are identical, mirror images of one another and are substantially the same as the previous embodiment. The mounting areas 24*a* and 24*b* are open towards the coupling sides 22*a* and 22*b* of the body portions 20*a* and 20*b* where they receive the mounting sides 52 and 54 of the interchangeable setting 50. In the present embodiment, however, the body portions 20*a* and 20*b* include mounting areas 24*a* and 24*b* of a different configuration than those discussed above with reference to FIGS. 1–3. In the present embodiment, both holding portions or mounting areas 24*a* and 24*b* define disc-shaped indentations being complimentary to the mounting sides 52 or 54 of the disc 51 of the setting 50. The mounting areas 24*a* and 24*b* include cylindrical surfaces 25*a* and 25*b*, closed sides 26*a* and 26*b*, and open tops 27*a* and 27*b*.

To form the jewelry article 10, the first mounting side 52 of the interchangeable setting 50 is first positioned in the mounting area 24*a* of the first body portion 20*a* from the direction of the coupling side 22*a*. As shown in FIG. 4B, the setting 50 is held in the mounting area 24*a* in all directions except towards the coupling side 22*a*. The second body portion 20*b* is positioned adjacent the first body portion 20*a* in direction A, as shown in FIG. 4A. The second mounting side 54 is then positioned in the second mounting area 24*b*. Of course, the setting 50 can be first positioned in either mounting area 24*a* or 24*b*. The magnetic elements 30*a*, 30*b*, and others not shown on the respective coupling surfaces 22*a* and 22*b* are aligned and magnetically couple. The mounting areas 24*a* and 24*b* positively engage the mounting sides 52 and 54 to hold the interchangeable setting 50.

In the present embodiment, either one or both of the body portions 20*a* and 20*b* is capable of rotating about the disc 51 of the setting in direction B to break the magnetic coupling of the elements 30*a*, 30*b* and those not shown. Rotation of the body portion 20 tangentially breaks the magnetic engagement between the magnetic elements 30*a*, 30*b* and those not shown. With the magnetic engagement broken, the body portions 20*a* and 20*b* can be separated, freeing the mounting sides 52 and 54 of the disc 51 from the complimentary mounting areas 24*a* and 24*b*.

Rotation of the body portion 20 occurs about an axis of rotation C where the center 58 of the disc 51 substantially aligns with the centers of the mounting areas 24. Because the setting 50 includes the disc 51 connected to a larger decorative portion 56 in the present embodiment, a necessary amount of space 55 on the cylindrical surface 53 of the disc 51 is required between the edges of the open top 27 of the body portion and the decorative portion 56. The space 55 allows the body portion 20 to rotate in direction B about axis C enough to break magnetic engagement of the elements (not shown) without the top of the body portion 20 interfering with the decorative portion 56 of the setting 50.

When the jewelry article 12 is worn, external contact of the decorative portion 56 could cause the disc 51 to tilt within the mounting areas 24*a* and 24*b* and pry the body portions 20*a* and 20*b* apart, which would be undesirable. In this and other embodiments, it will be appreciated that the decorative portion 56 can define a low profile extending beyond the coupled body portions 20*a* and 20*b*. The decorative portion 56 can also have contact with outer surfaces of the body portions 20*a* and 20*b*, which will not interfere with the coupling and uncoupling thereof and which can prevent tilting of the setting 50. For example, in FIGS. 4A–B, a structure 59 is positioned adjacent the decorative portion 56 and is capable of engaging a top, outer surface of the body portion 20*a*, yet still allow the body portion 20*a* to rotate about central axis C. The structure 59 can reduce the potential of prying the body portions 20*a* and 20*b* apart due to external contact to the setting 50.

Figure 5A:
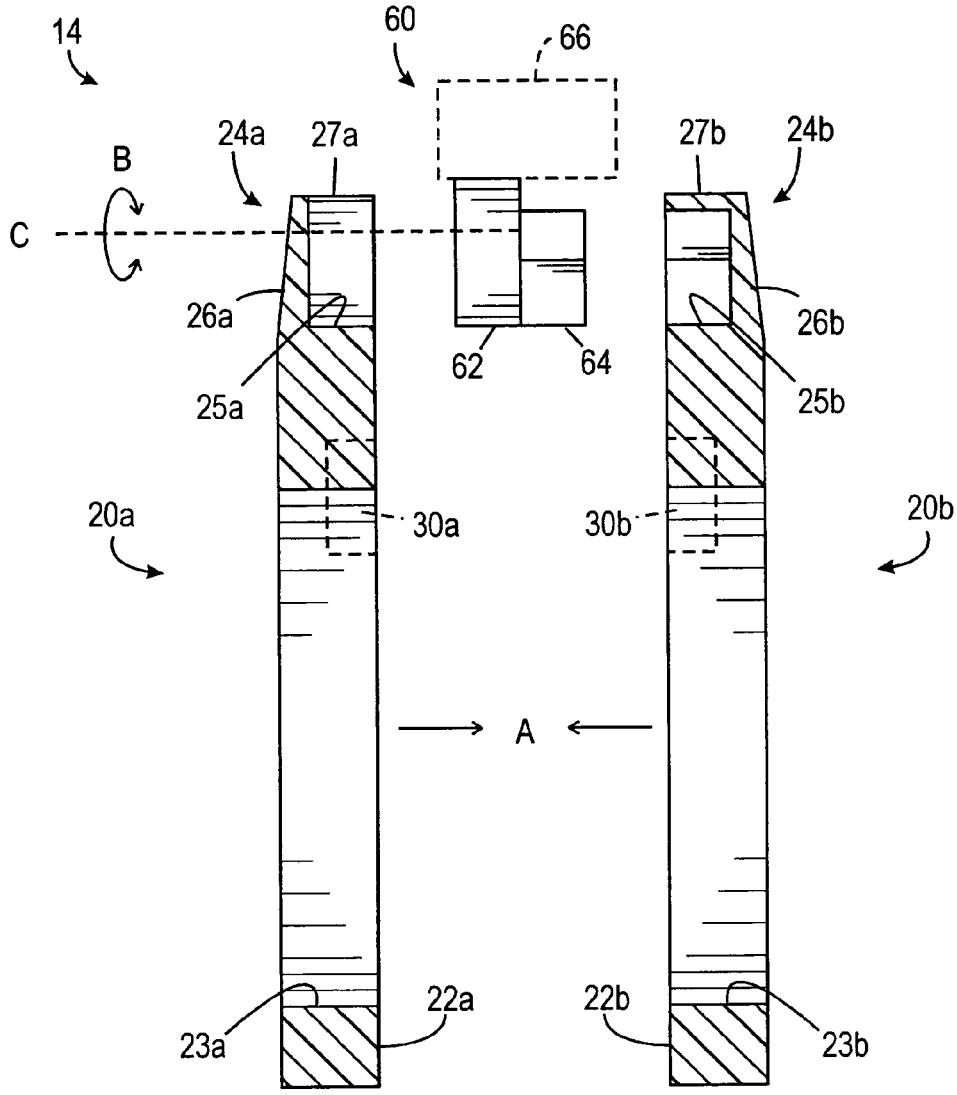
FIGS. 5A–B illustrate various views of a third embodiment of a jewelry article having magnetically coupling body portions and an interchangeable setting according to the present invention.
Figure 5B:
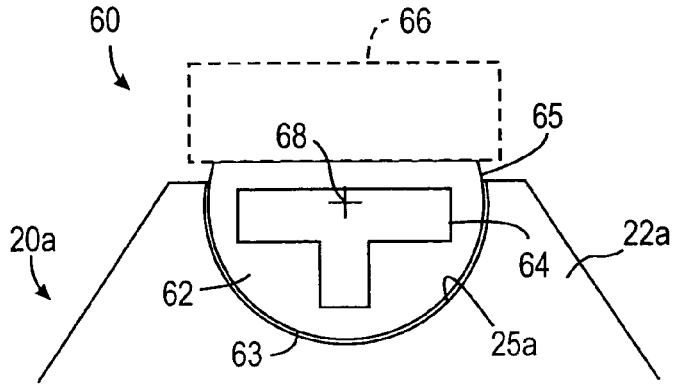

Referring to FIGS. 5A–B, another embodiments of a jewelry article 14 having magnetically coupling body portions 20*a* and 20*b* and an interchangeable setting 60 according to the present invention is illustrated. In FIG. 5A, the first and second body portions 20*a* and 20*b* of the jewelry article 14 are shown in a stage of coupling to one another to hold the interchangeable setting 60. The first and second body portions 20*a* and 20*b* are illustrated in a side, cross-sectional view to show internal details. In the front view of FIG. 5B, the setting 60 is shown installed in a mounting area 24*a* of the first body portion 20*a*.

The interchangeable setting 60 includes a first mounting portion 62, a second mounting portion 64, a decorative portion 66. The first mounting portion 62 forms a disc structure. Being disc-shaped, the disc portion 62 has a cylindrical surface 63 defined by a radius R from a center 68. A circumferential dimension of the cylindrical surface 63 of the disc portion 62 is at least greater than half of a circle. The decorative portion 66 is attached to the top of the disc portion 62 and can have any particular shape. The second mounting portion 64 forms a rectilinear structure, such as the T-shaped structure illustrated. Having the T-shape can prevent the setting from rotating about an axis within the second mounting area, which can prevent the setting from tilting within the second mounting area 24*b* and prying the body portions 20*a* and 20*b* apart due to external contact.

To form the jewelry article 14, one of the mounting portions, for example the disc portion 62, of the interchangeable setting 50 is first positioned in the holding portion or mounting area 24*a* of the first body portion 20*a* from the direction of the coupling side 22*a*. As best shown in FIG. 5B, the first mounting area 24*a* is complimentary to the disc portion 62. The second body portion 20*b* is then positioned adjacent the first body portion 20*a* in direction A. The rectilinear portion 64 is positioned in the second mounting area 24*a*, which is shaped complimentary to the rectilinear portion 64.

Once coupled, the magnetic elements 30*a*, 30*b* and those not shown on the respective coupling surfaces 22*a* and 22*b* magnetically couple. The mounting areas 24*a* and 24*b* therefore positively hold the interchangeable setting 50. In the present embodiment, the first body portion 20*a* is rotatable about the disc portion 62 of the setting 60. Being rectilinear, the rectilinear portion 64 and the second mounting area 24*b* do not allow the second body portion 20*b* to rotate. The body portions 20*a* and 20*b* are uncoupled by rotating the first body portion 20*a* about center axis C. Rotation of the first body portion 20*a* tangentially breaks the magnetic coupling of the magnetic elements.

As best shown in FIG. 5B, a necessary amount of space 65 on the cylindrical surface of the disc portion 62 is required between the edges of the open top 27 of the body portion 20*a* and the decorative portion 66 to allow the body portion 20*a* to rotate in direction B about axis C enough to break magnetic engagement of the magnetic elements. The space 65 is required so the top of the body portion 20 does not interfere with the decorative portion 56 of the setting 50.

Figure 6A:
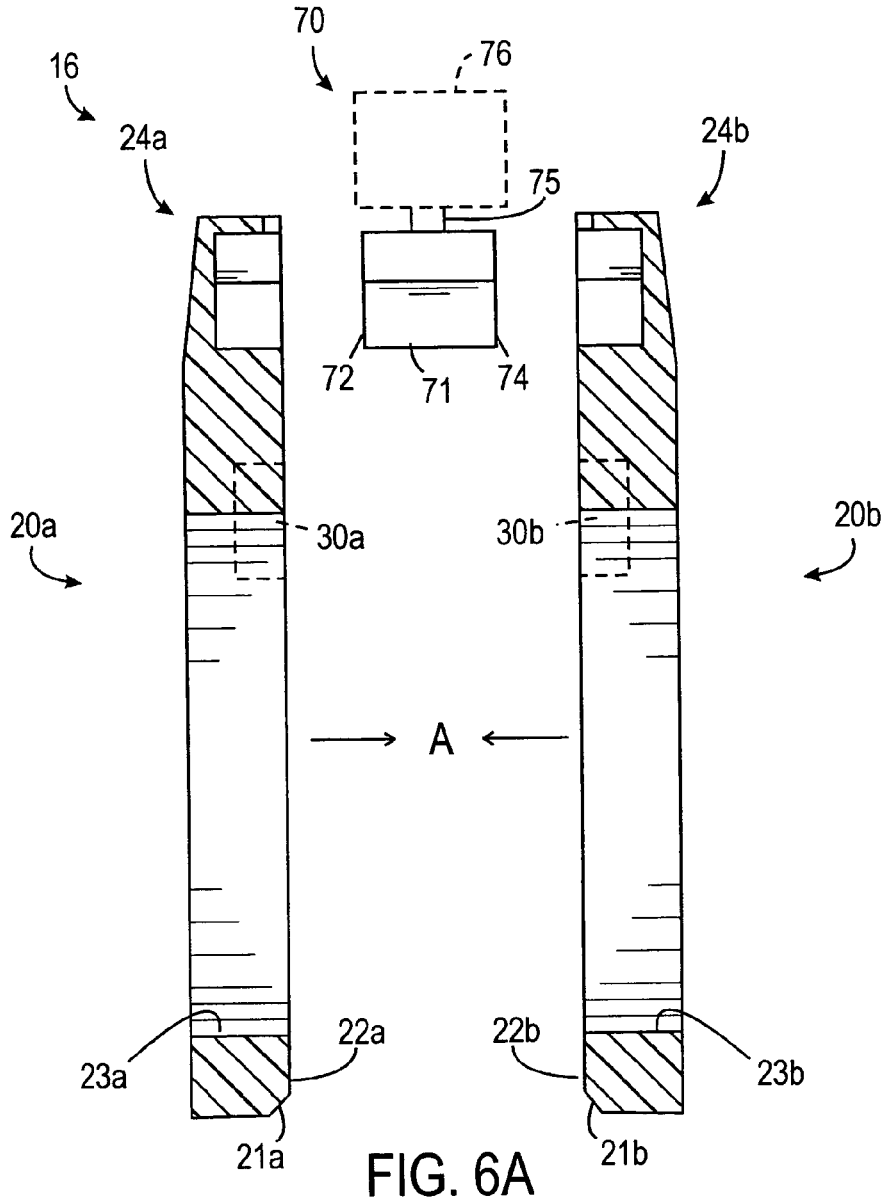
FIGS. 6A–B illustrate various views of a fourth embodiment of a jewelry article having magnetically coupling body portions and an interchangeable setting according to the present invention.
Figure 6B:
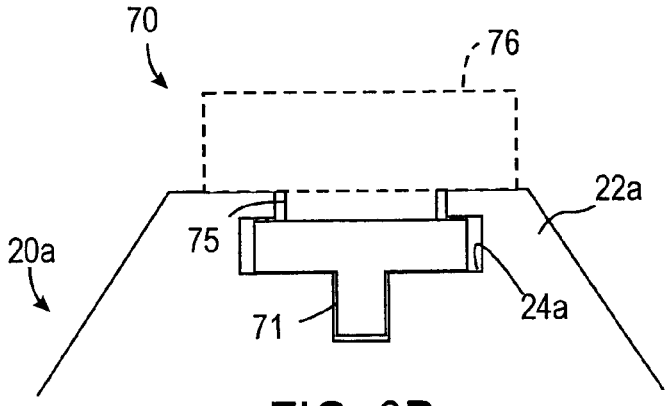

Referring to FIGS. 6A–B, yet another embodiment of a jewelry article 16 having magnetically coupling body portions 20*a* and 20*b* and an interchangeable setting 70 according to the present invention is illustrated. In FIG. 6A, the first and second body portions 20*a* and 20*b* of the jewelry article 16 are shown in a stage of coupling to one another to hold the interchangeable setting 70. The first and second body portions 20*a* and 20*b* are illustrated in a side, cross-sectional view to show internal details. In the front view of FIG. 6B, the setting 70 is shown installed in a mounting area 24*a* of the first body portion 20*a*.

As discussed in previous embodiments, the interchangeable settings according to the present invention preferably include at least one mounting side having a surface defined by a radius, such as a radial, spherical, or cylindrical surface, that allows for a body portion of the jewelry article to rotate thererabout. In the present embodiment of FIGS. 6A–B, however, the interchangeable setting 70 includes a rectilinear portion 71 connected to a decorative portion 76 by an attachment portion 75. The rectilinear portion 71 includes a first mounting portion or end 72 and a second mounting portion or end 74. In the present embodiment, the rectilinear portion 71 defines a T-shaped structure, although this is not strictly necessary: any structural shape, which will not allow rotation thereon, can be used. At least one dimension, either lateral or longitudinal, of the rectilinear portion 71 is greater than a dimension of the attachment portion 71 so that the mounting ends 72 and 74 can be positively held by the mounting areas 24*a* and 24*b* of the body portions 20*a* and 20*b*, as described below.

To form the jewelry article 16, one of the mounting ends, for example the first end 72, is positioned in the mounting area 24*a* of the first body portion 20*a* from the direction of the coupling side 22*a*. As best shown in FIG. 5B, the first mounting area 24*a* is complimentary to the rectilinear first end 72. The second body portion 20*b* is then positioned adjacent the first body portion 20*a* in direction A. The second end 74 is positioned in the second mounting area 24*a*, which is shaped complimentary to the rectilinear second end 74.

In the present embodiment, neither of the body portions 20*a* and 20*b* is rotatable. The body portions 20*a* and 20*b* are uncoupled in a reverse of direction A. This operation of uncoupling is not preferred, because breaking the coupling between the magnetic elements 30*a*, 30*b*, and those not shown in the reverse of direction A requires more force than breaking the coupling tangentially as discussed above with reference to previous embodiments. To facilitate uncoupling the body portions 20*a* and 20*b* in the reverse of direction A, each body portion 20*a* and 20*b* can include a groove 21*a* and 21*b* permitting a person to separate the body portions 20*a* and 20*b* with a fingernail or the like. The grooves 21*a* and 21*b* can be decorative to disguise their function.

Figure 7A:
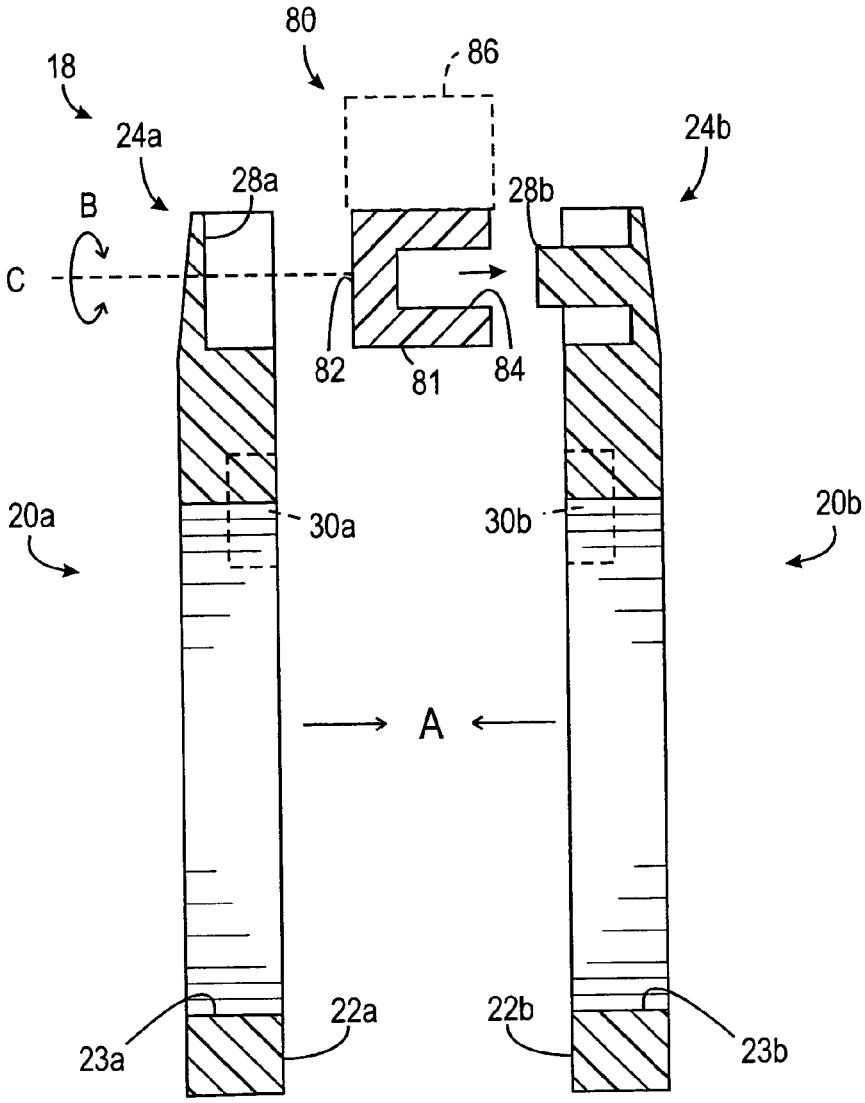
FIGS. 7A–B illustrate various views of a fifth embodiment of a jewelry article having magnetically coupling body portions and an interchangeable setting according to the present invention.
Figure 7B:
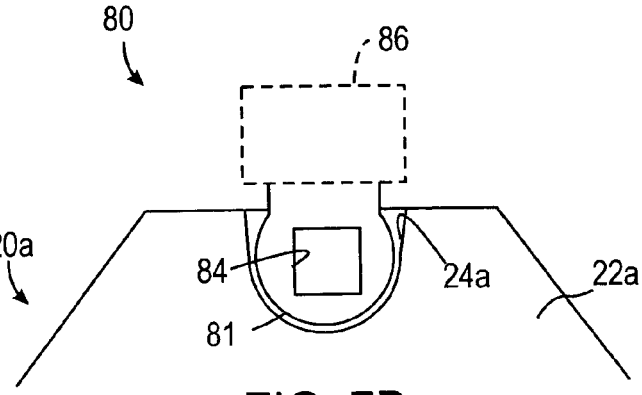

Referring to FIGS. 7A–B, yet another embodiment of a jewelry article 18 having magnetically coupling body portions 20*a* and 20*b* and an interchangeable setting 80 according to the present invention is illustrated. In FIG. 7A, the first and second body portions 20*a* and 20*b* of the jewelry article 18 are shown in a stage of coupling to one another to hold the interchangeable setting 80. The first and second body portions 20*a* and 20*b* and the setting 80 are illustrated in a side, cross-sectional view to show internal details. In a frontal view of FIG. 7B, the setting 80 is shown installed in a mounting area 24*a* of the first body portion 20*a*.

The interchangeable setting 80 includes a mounting portion 81 connected to a decorative portion 86. As discussed in previous embodiments, the interchangeable settings according to the present invention include mounting portions having positive structures, and the body portions have holding portions defining negative areas. In the present embodiment of FIGS. 7A–B, however, the mounting portion 81 has a first mounting surface 82 and defines a second mounting area 84. The first holding portion 24*a* on the body portion 20*a* has a flat structure 28*a*, and the second holding portion 24*b* on the body portion 20*b* has a projecting structure 28*b* being substantially complimentary to the mounting area 84 of the setting 80. For example, as shown in FIG. 7B, the second mounting area 84 can have a rectilinear shape so that the corresponding second holding structure 28*b*, which is not shown in FIG. 7B, can also have a substantially equivalent rectilinear shape to prevent rotation of the setting 80.

To form the jewelry article 18, the projecting structure 28*b* can be inserted into the second mounting area 84 from the direction of the coupling side 22*a*. The second body portion 20*b* can then be positioned adjacent the first body portion 20*a* in direction A so that the flat structure 28*b* is positioned adjacent the mounting surface 82. To uncouple the body portions 20*a* and 20*b* in the present embodiment, the first body portion 20*a* is rotatable about the mounting portion 81 installed in the holding area 24*a*. The rotation tangentially breaks the magnetic coupling between the magnetic elements 30*a* and 30*b* on the body portions 20*a* and 20*b*. To allow for rotation of the first body portion 20*a*, sufficient clearances are needed between the holding portion 24*a* and the mounting portion 81 and between the first body portion 20*a* and the decorative portion 86.

Figures 8A, 8B:
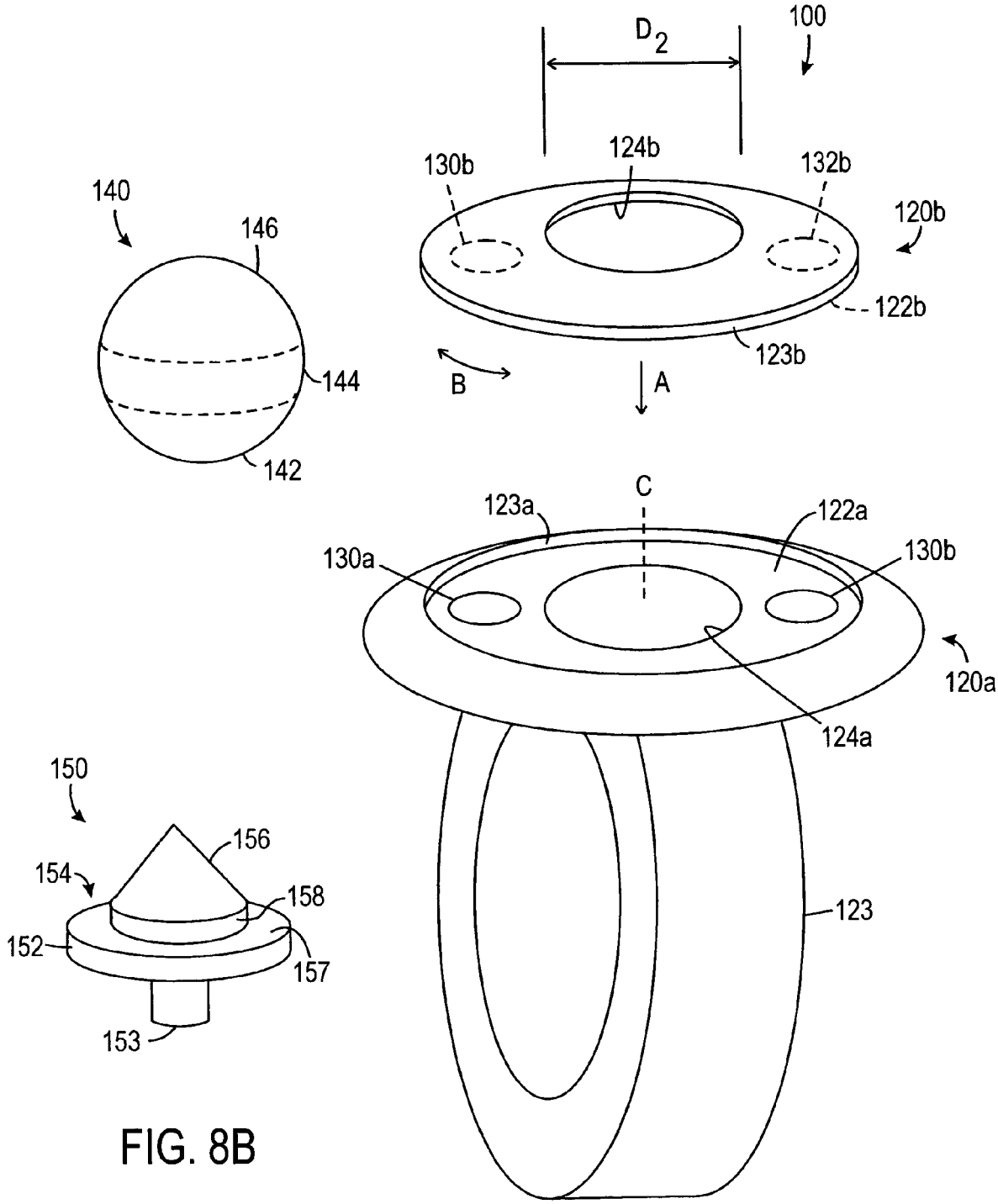
FIG. 8A illustrates a perspective view of a sixth embodiment of a jewelry article having magnetic elements and an interchangeable setting according to the present invention.
FIG. 8B illustrates a perspective view of an embodiment of an interchangeable setting for use with the jewelry article of FIG. 8A.

Referring to FIG. 8A, another embodiment of a jewelry article 100 having magnetically coupling body portions 120*a* and 120*b* and an interchangeable setting 140 in accordance with the present invention is illustrated. A first body portion 120*a* and a second body portion 120*b* are separable and magnetically couple together to form a part of the jewelry article 100. The first body portion 120*a* is part of or is attached to the jewelry article 100. For example, in the present embodiment, the first body portion 120*a* is a bezel of a ring and is connected to an annular shank 123. Alternatively, it will be appreciated that the first body portion 120*a* can be part of or attached to a pendent, bracelet, earring, broach, or other jewelry article.

The first body portion 120*a* defines a coupling surface 122*a*, which is recessed and forms a rim 123*a* around the bezel 120*a*. A holding portion or mounting area 124*a* is defined in the coupling surface 122*a*. The mounting area 124*a* receives a portion of the interchangeable setting 140 therein, as described below. A first pair of magnetic elements 130*a* and 130*b* are disposed in the coupling surface 122*a* and adjacent the mounting area 124*a*. The second body portion or bezel cap 120*b* has a coupling surface 122*b* with magnetic elements 130*b* and 132*b*disposed therein. The bezel cap 120*b* has a holding portion or mounting area 124*b*, which is an opening defined in the bezel cap 120*b* in the present embodiment. The setting 140 defines a sphere in the present embodiment, but this is not strictly necessary, as is evidenced herein. In general, the setting 140 includes a first mounting portion 142, a second mounting portion 144, and a decorative portion 146.

To assemble the jewelry article 100, the first mounting portion 142 of the setting 140 is disposed in the mounting area 124*a* of the bezel 120*a* and is positively held therein in all directions except towards the coupling surface 122*a*. The coupling surface 122*b* of the bezel cap 120*b* is then positioned adjacent the coupling surface 122*a* in direction A. The decorative portion 146 of the setting 140 is positioned through the mounting opening 124*b* for display, and the mounting opening 124*b* engages the second mounting portion 144 of the setting 140. The decorative portion 146 has a dimension less than a dimension $D_2$ of the mounting opening 124*b*, and the second mounting portion 144 has a dimension greater than the dimension $D_2$ of the mounting opening 124*b*. The bezel cap 120*b* is held to the bezel 120*a* by the mating of the first and second pairs of magnet elements 130*a*, 130*b* and 132*a*, 132*b*. When attached, the cap 120*b* holds the interchangeable setting 140 onto the bezel 120*a*.

Preferably, the decorative portion 146 of the setting defines a low profile above the bezel cap 120*b* to prevent inadvertent uncoupling of the cap 120*b* and bezel 120*a*. In addition, the edge 123*b* of the cap 120*b* is preferably flush with the rim 123*a* of the bezel 120*a*. In a preferred embodiment, the cap 120*b* is removed from the bezel 120*a* by rotating the cap 120*b* in direction B to tangentially break the magnetic coupling of the magnetic elements 130*a*, 130*b* and 132*a*, 132*b*. Thus, the rim 123*a*, edge 123*b*, opening 124*b*, and second mounting portion 144 each define radii from a center C of rotation.

Once uncoupled, a new setting (not shown) having a different shape or aesthetic quality can then be held with the magnetically coupling bezel 120*a* and cap 120*b*. In addition, the cap 120*b* can include decorative elements, such as inlays or embossed surfaces, in which case the cap 120*b* can also be interchanged with a new cap (not shown) having a different aesthetic characteristic. The setting 140 and the cap 120*b* can also be used with other jewelry articles (not shown). Therefore, the present invention enables a person to form numerous combinations of interchangeable elements to compose jewelry articles with different aesthetic characteristics.

In an alternative aspect to the present embodiment, the coupling surface 122*a* can define a cavity (not shown) for holding miscellaneous items. For example, the cavity may hold medication. The bezel cap 120*b* can be interchangeable and can have a setting (not shown) permanently attached thereto. The cap 120*b* can magnetically couple to the first body portion to hold the miscellaneous items in the cavity.

Referring to FIG. 8B, an alternative embodiment of an interchangeable setting 150 for the jewelry article of FIG. 8A is illustrated. The setting 150 includes a first mounting portion 152, a second mounting portion 154, and a decorative portion 156. The first mounting portion 152 defines a disc, but can have any number of shapes. The first mounting portion 152 includes an axial member 153 extending therefrom. The axial member 153 stabilizes the setting 150 when held between coupling portions 120*a* and 120*b* of the jewelry article 100. For example, the axial member 153 positions in a complimentary bore (not shown) in the mounting area 124*a* of the bezel 120*a* in FIG. 8A and prevents tilting of the setting 150.

The second mounting portion 154 defines a shoulder 157 with the first mounting portion 152 and defines a cylindrical surface 158 with the decorative portion 156. The shoulder 157 engages the bezel cap 120*b* of FIG. 8A adjacent the mounting area 124*b*. The decorative portion 156 extends above the mounting area 124*b* and can have any particular shape. To allow the decorative portion 156 to be positioned through the mounting area 124*b* of the bezel cap 120*b* of FIG. 8A, the decorative portion 156 has a dimension that is less than to the dimension $D_2$ of the mounting area 124*b*. The cylindrical surface 158 of the second mounting portion 154 allows the bezel cap 120*b* to be rotated thereabout when uncoupling the bezel cap 120*b* from the bezel 120*a*.

Figure 9A:
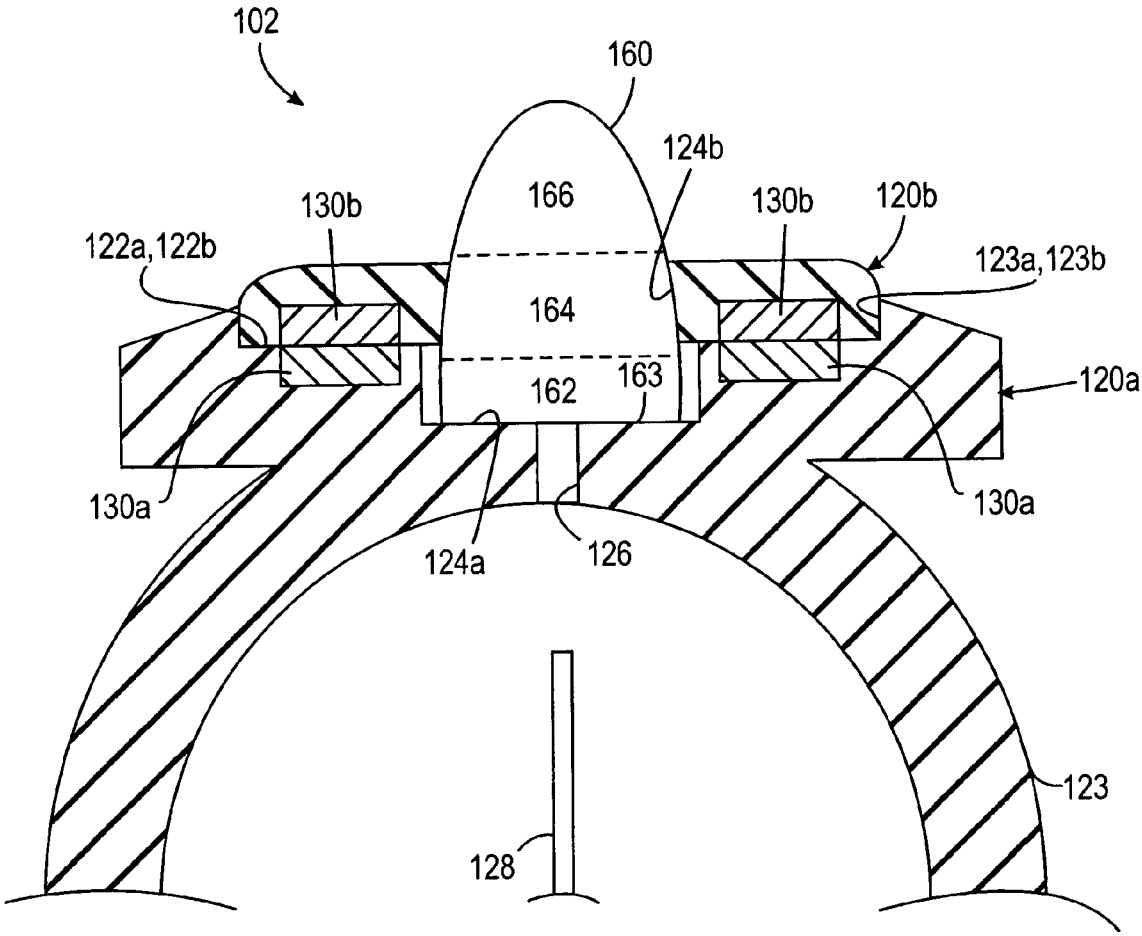
FIG. 9A illustrates a cross-sectional view of a seventh embodiment of a jewelry article having magnetically coupling body portions and an interchangeable setting according to the present invention.

Referring to FIG. 9A, yet another embodiment of a jewelry article 102 having magnetically coupling body portions 120*a* and 120*b* and an interchangeable setting 160 in accordance with the present invention is illustrated in a cross-sectional view. The first and second body portions 120*a* and 120*b* are substantially similar to those discussed above with reference to FIG. 8A. For brevity, like reference numerals are used to indicate substantially similar elements between the embodiments of FIGS. 8A and 8B.

In the present embodiment, the setting 160 defines a bullet shape having a first mounting portion 162, a second mounting portion 164, and a decorative portion 166. As shown in FIG. 8B, the first mounting portion 162 defines a flat surface 163 adjacent the mounting area 124*a*. The flat surface 163 can prevent the setting 160 from being tilted and from prying the body portions 120*a* and 120*b* apart.

Assembly of the jewelry article 100 is substantially similar to that described above with reference to FIG. 8A. Once assembled, the mounting opening 124*b* engages the second mounting portion 164 of the setting 160, and the bezel cap 120*b* is held to the bezel 120*a* by the mating of the first and second pairs of magnet elements 130*a*, 130*b* and 132*a*, 132*b*.

In this embodiment, the cap 120*b* is removed from the bezel 120*a* by inserting an instrument 128 through a passage 126 defined adjacent the mounting area 124*a*. With the instrument 128, the setting 160 and the cap 120*b* are pushed away from the mounting area 124*a* and bezel 120*a* to break the magnetic coupling of the magnetic elements 130*a*, 130*b* and 132*a*, 132*b*. With the cap 120*b* removed in this manner, the rim 123*a*, edge 123*b*, opening 124*b*, and second mounting portion 164 can have any particular shape and need not be circular.

Figure 9B:
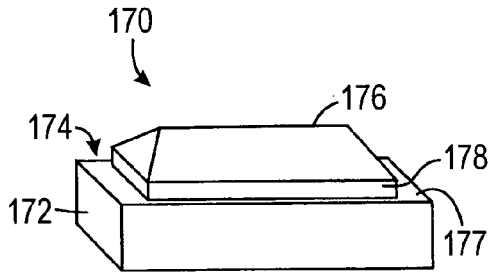
FIG. 9B illustrate a perspective view of an embodiment of an interchangeable setting for use with the jewelry article of FIG. 9A.

Referring to FIG. 9B, an alternative embodiment of an interchangeable setting 170 for the jewelry article of FIG. 9A is illustrated. The setting 170 includes a first mounting portion 172, a second mounting portion 174, and a decorative portion 176. The first mounting portion 172 defines a rectilinear structure. The second mounting portion 174 defines a shoulder 177 with the first mounting portion 172 and defines a rectilinear surface 178 with the decorative portion 176. The shoulder 177 engages the bezel cap 120*b* of FIG. 9A adjacent the mounting opening 124*b*. The decorative portion 176 extends above the shoulder 174 and can have any particular shape.

To allow the decorative portion 176 to be positioned through the mounting area 124*b* of the bezel cap 120*b* of FIG. 9A, the decorative portion 176 has a dimension that is less than the dimension $D_2$ of the mounting area 124*b*. Of course, the mounting opening 124*b* of the bezel cap 120*b* will be rectilinear. The rectilinear surface 178 of the second mounting portion 174 does not allow the bezel cap 120*b* to be rotated thereabout. Consequently, the rectilinear mounting opening 124*b* and surface 178 of the present embodiment of the setting 170 are particularly suited for the method of uncoupling the bezel cap 120*b* and setting 170 using a small instrument described above.

As evidenced by the jewelry articles 10, 12, 14, 16, 18, 100, 102 and the settings 40, 50, 60, 70, 80, 140, 150, 160, and 170 of FIGS. 1–9B, holding portions of the body portions and mounting portions of the settings according to the teachings of the present invention can have a number of configurations. Consequently, it is understood that additional embodiments of holding and mounting portions with other shapes or structures not explicitly shown or described herein also fall within the scope of the present invention. For example, the shapes or structures for the holding and mounting portions can include, but are not limited to radial, rectilinear, triangular, or other geometrical shapes or structures. In addition, other shapes or structures can include curved or freeform shapes or structures capable of engaging or mating with a complementary holding portion or mounting portion. Moreover, with the benefit of the present disclosure, one of ordinary skill in the art will appreciate that a mounting portion of the setting need not exclusively define a positive structure while a holding portion of a body portion defines a negative area. Thus, as evidenced by the embodiment of FIGS. 7A–B, one of ordinary skill in the art will appreciate that a mounting portion of a setting can define a negative area while a holding portion of a body portion can define a positive structure capable of engaging or mating with the negative area.

Figure 10A:
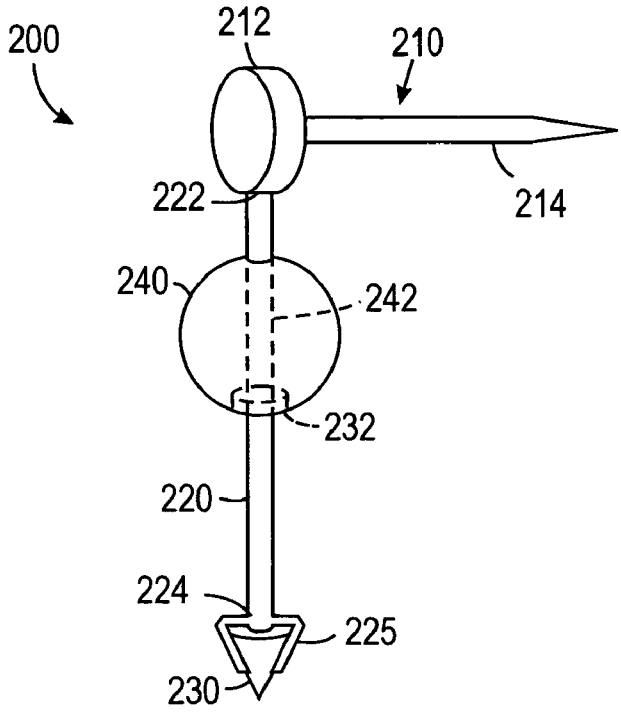
FIG. 10A–B illustrate embodiments of jewelry articles having magnetic elements and movable settings according to the present invention.

Referring to FIG. 10A, a jewelry article 200 having magnetic elements 230 and 232 and a movable setting 240 is illustrated according to the present invention. The jewelry article 200 includes a body 210, which in the present embodiment is an earring having a stud 212 and shank 214. The earring 200 also includes an elongate or longitudinal member 220 having a proximal end 222 and a distal end 223. The proximal end 222 is attached to the stud 212, and the axial member 220 extends down from the earring 210. In one embodiment, the proximal end 224 is permanently attached to the stud 212. Alternatively, the proximal end 222 can be detachable from the stud 212, allowing the setting 240 to be interchanged. For example, the proximal end 222 can be threaded into a threaded hole in the stud 222 or can be detachably connected to the stud 212 by other methods known in the art.

A first magnetic element 230 is attached to the distal end 224 of the axial member 220. Attachment of the first magnetic element 230 to the distal end 224 can be achieved using a number of methods known in the art. For example, the magnetic element 230 can be a rare earth magnet held by a plurality of prongs 225 attached to the distal end 224. The first magnetic element 230 has a specific polarity facing the axial member 220.

The setting 240 is movably disposed on the axial member 220. For example, the setting 240 defines a bore 242 having the axial member 220 disposed therethrough. One end of the setting 240 has a second magnetic element 232 with a polarity opposing that of the first magnetic element 230 on the distal end 224 of the axial member 220. For example, the second magnetic element 232 can be a rare earth magnet affixed with epoxy in a hole in the end of the setting 240. The first and second magnetic elements 230 and 232 magnetically repel one another when in proximity, and the weight of the setting 240 tends to force the magnetic elements 230 and 232 in proximity. The opposing polarities of the magnets elements 230 and 232 act to suspend the setting 240 on the axial member 220 and allow the setting 240 to move or oscillate along the axial member 220 in response to external movements and gravity.

Figure 10B:
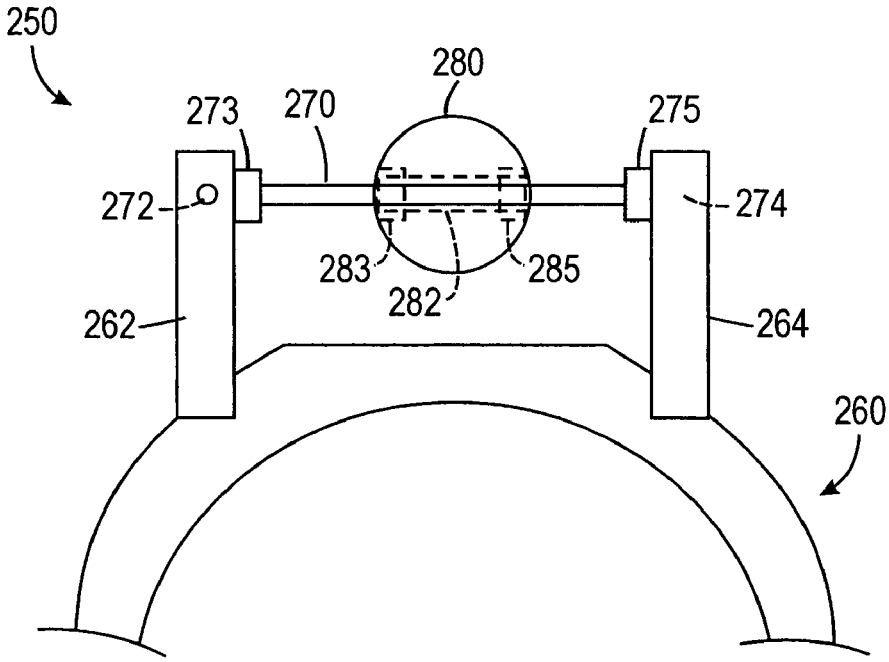

Referring to FIG. 10B, another a jewelry article 250 having magnetic elements 273, 275, 283, and 285 and a movable setting 280 is illustrated according to the present invention. The jewelry article 250 includes a body 260, which in the present embodiment is a ring or bracelet. The jewelry article 250 also includes an elongate or longitudinal member 270 having a first end 272 and a second end 274. Both ends 272 and 274 are attached to the body 260 so that the longitudinal member 270 is positioned adjacent the body 260. In one embodiment, one of the ends 272 is permanently attached to a portion 262 of body 260, while the other end 272 is detachable from a portion 264 of the body 260, allowing the setting 270 to be interchanged. For example, the one end 272 can be attached to the portion 262 with a hinge mechanism (not shown), and the other end 274 can detachably couple to a clasp mechanism (not shown) on the portion 264 of the body 260.

A first magnetic element 273 is attached adjacent the first end 272 of the longitudinal member 270. A second magnetic 275 element is attached adjacent the second end 274 of the longitudinal member 270. The magnetic elements 273 and 275 can be attached to the portions 262 and 264 of the body 260 or can be attached to the longitudinal member 270. The setting 280 is movably disposed on the longitudinal member 270. For example, the setting 280 can define a bore 282 having the longitudinal member 270 disposed therethrough. Besides being straight, the longitudinal member 270 can define a radius of curvature (not shown), in which case the bore 282 can also define an equivalent radius of curvature.

The sides of the setting 280 include magnetic elements 283 and 285. The magnetic elements 273 and 275 adjacent the ends of the longitudinal member 270 magnetically repel the magnetic elements 283 and 285 on the setting 280 when in proximity. The opposing polarities of the magnetic elements 272, 283, 275, and 285 allow the setting 280 to move or oscillate along the longitudinal member 270 in response to external movements.

With the benefit of the present disclosure, one of ordinary skill in the art of jewelry design will recognize that the present invention is applicable to jewelry articles other than the embodiment of rings and earrings explicitly illustrated herein. For example, the present invention is applicable to other embodiments of jewelry articles other than those explicitly illustrated herein, including but not limited to bracelets, chokers, necklaces, earrings, broaches, or pendants.

For example, instead of forming a composite ring, the magnetically coupling body portions of the present invention could form a composite, bracelet, a composite earring, or a composite choker. For example, instead of forming a bezel for a ring, the magnetically coupling body portions of the present invention could form a pendant for use with a necklace, form a bezel of an earring, or form a broach for use with a pin. One of ordinary skill in the are would find it a routine undertaking to modify the illustrated embodiments of the present invention to be used for these types of jewelry articles. For example, instead of having a movable setting on a ring or an earring, a bracelet or pendant can include a movable setting as disclosed herein.

While the invention has been described with reference to the preferred embodiments, obvious modifications and alterations are possible by those skilled in the related art. Therefore, it is intended that the invention include all such modifications and alterations to the full extent that they come within the scope of the following claims or the equivalents thereof.

What is claimed is:

1. A jewelry article comprising:

a setting having a mounting portion;

a first body portion having a holding portion, the holding portion capable of holding the mounting portion except from at least one direction; and a second body portion capable of magnetically coupling with the first body portion, the second body portion capable of holding the mounting portion from the at least one direction when magnetically coupled to the first body portion, wherein the first and second body portions have the same surface area and the body portions are separable from one another by non-rotational movement of the second body portion relative to the first body portion in the at least one direction to break magnetic coupling between the body portions.

2. The jewelry article of claim 1, wherein at least one of the body portions comprises a magnetic element disposed thereon.

3. The jewelry article of claim 2, wherein the magnetic element is a rare earth magnet.

4. The jewelry article of claim 1, wherein the first and second body portions magnetically couple together to form a ring, a bracelet, an earring, a choker, a bezel, a pendant, or a broach.

5. The jewelry article of claim 1, wherein the mounting portion of the setting includes a first rectilinear structure, and wherein the holding portion of the first body portion includes a second rectilinear structure being substantially complementary to the first rectilinear structure, whereby the first and second rectilinear structures mate with one another in the at least one direction when mounting the setting on the first body portion and hold the setting except from the at least one direction.

6. The jewelry article of claim 5, wherein the second rectilinear structure defines a negative area in the first body portion.

7. The jewelry article of claim 1, wherein:

the first body portion includes a first half of a ring having a first surface, the holding portion defines a negative area in the first surface in which the mounting portion of the setting positions, and the second body portion includes a second half of the ring having a second surface magnetically coupling to the first surface.

8. A jewelry article comprising:

a setting;

first means for holding the setting except from at least one direction;

second means for holding the setting from the at least one direction, wherein the first means for holding the setting and the second means for holding the setting have the same surface area;

means for magnetically coupling the first and second means for holding the setting; and means for separating the first and second means by non-rotational movement of said second means relative to said first means in the at least one direction to break magnetic coupling between the first and second means.

9. The jewelry article of claim 8, wherein the means for magnetically coupling the first and second means comprises at least one magnet.

10. The jewelry article of claim 8, further comprising means for preventing tilting of the setting in the magnetically coupled first and second means.

11. The jewelry article of claim 8, wherein the means for separating the first and second means comprises means for pulling apart the first and second means.

12. A jewelry article comprising:

a setting having a mounting portion;

a first body portion having a holding portion, the holding portion capable of holding the mounting portion except from at least one direction; and a second body portion capable of magnetically coupling with the first body portion, the second body portion capable of holding the mounting portion from the at least one direction when magnetically coupled to the first body portion; wherein:

the body portions are separable from one another in the at least one direction to break magnetic coupling between the body portions; and the means for separating the first and second means comprises means for pushing the setting in the at least one direction to separate the first and second means and break magnetic coupling therebetween.

13. A ring comprising:

an interchangeable setting;

a first half of the ring having a first inner surface and a finger engaging portion, the setting mounting on the first half of the ring such that the first half of the ring holds the setting except from one direction, wherein the first inner surface includes a first rectilinear structure and the setting includes a second rectilinear structure being substantially complementary to the first rectilinear structure, whereby the first and second rectilinear structures mate with one another in the one direction when mounting the setting on the first half of the ring and hold the setting except from the one direction; and a second half of the ring having a second inner surface and a finger engaging portion, the second surface magnetically coupling to the first inner surface of the first half of the ring such that the second half of the ring holds the setting from the one direction, wherein the magnetically coupled halves of the ring are separable from one another by non-rotational movement of one half relative to the other half in the one direction to break the magnetic coupling between the halves of the ring and to interchange the setting.

14. The ring of claim 13, wherein the inner surface of at least one of the halves of the ring includes a rare earth magnet.

15. The ring of claim 13, wherein the first and second halves of the ring are substantially identical.

16. The ring of claim 13, wherein the first rectilinear structure includes a negative area defined in the first surface of the first half of the ring.

17. The ring of claim 13, wherein the setting includes a mounting portion engaged by portions of the first and second surface and includes a decorative portion extending beyond the magnetically coupled halves of the ring.

* * * * *